US009524642B2

(12) United States Patent
Tonguz et al.

(10) Patent No.: US 9,524,642 B2
(45) Date of Patent: Dec. 20, 2016

(54) TRANSITIONING TO A ROADSIDE UNIT STATE

(71) Applicant: CARNEGIE MELLON UNIVERSITY, Pittsburgh, PA (US)

(72) Inventors: Ozan K. Tonguz, Pittsburgh, PA (US); Wantanee Viriyasitavat, Pittsburgh, PA (US)

(73) Assignee: Carnegie Mellon University, Pittsburgh, PA (US)

( * ) Notice: Subject to any disclaimer, the term of this patent is extended or adjusted under 35 U.S.C. 154(b) by 190 days.

(21) Appl. No.: 14/371,802

(22) PCT Filed: Jan. 18, 2013

(86) PCT No.: PCT/US2013/022251
§ 371 (c)(1),
(2) Date: Jul. 11, 2014

(87) PCT Pub. No.: WO2013/109960
PCT Pub. Date: Jul. 25, 2013

(65) Prior Publication Data

US 2014/0354451 A1 Dec. 4, 2014

Related U.S. Application Data

(60) Provisional application No. 61/632,116, filed on Jan. 18, 2012.

(51) Int. Cl.
*G08G 1/09* (2006.01)
*G08G 1/0967* (2006.01)

(52) U.S. Cl.
CPC ..... *G08G 1/0967* (2013.01); *G08G 1/096716* (2013.01); *G08G 1/096741* (2013.01); *G08G 1/096791* (2013.01)

(58) Field of Classification Search
None
See application file for complete search history.

(56) References Cited

U.S. PATENT DOCUMENTS

2004/0128062 A1* 7/2004 Ogino ..... G01C 21/26 701/400
2005/0088318 A1* 4/2005 Liu ..... G08G 1/161 340/902

(Continued)

FOREIGN PATENT DOCUMENTS

GB 2431761 A * 5/2007 ..... G08G 1/161
JP 2002-234411 8/2002

(Continued)

OTHER PUBLICATIONS

Leonitiadis et al., Opportunistic SpatioTemporal Dissemination System for Vehicular Networks, UCL.*

(Continued)

*Primary Examiner* — Brian Zimmerman
*Assistant Examiner* — Kevin Lau
(74) *Attorney, Agent, or Firm* — Fish & Richardson P.C.

(57) ABSTRACT

A method performed by one or more processors, comprising: receiving a notification message indicative of an occurrence of an event; determining that a position of a vehicular device that is associated with the one or more processors is located on a boundary of a reachability area surrounding a source of the event; determining that a direction of movement of the vehicular device is towards the source; responsive to determining that the position is on the boundary of the reachability area and that the direction of movement of the vehicular device is towards the source, entering a roadside unit state; detecting one or more vehicular devices that are uninformed of the occurrence of the event and that are located outside of the reachability area; and broadcasting the (Continued)

notification message to the one or more uninformed vehicular devices.

20 Claims, 5 Drawing Sheets

(56) References Cited

U.S. PATENT DOCUMENTS

| | | | | |
|---|---|---|---|---|
| 2007/0117525 | A1* | 5/2007 | Osafune | G08G 1/20 455/99 |
| 2010/0128653 | A1* | 5/2010 | Tateson | H04L 1/188 370/315 |

FOREIGN PATENT DOCUMENTS

| | | |
|---|---|---|
| JP | 2010-039754 | 2/2010 |
| KR | 10-2009-0070679 | 7/2009 |
| KR | 10-0911181 B1 | 8/2009 |
| KR | 10-1048650 | 7/2011 |
| WO | WO2013109960 | 7/2013 |

OTHER PUBLICATIONS

International Preliminary Report and Written Opinion in corresponding PCT Application No. PCT/US2013/022251, dated Jul. 31, 2014, pp. 1-5.

* cited by examiner

TRANSITIONING TO A ROADSIDE UNIT STATE

CLAIM OF PRIORITY

This application claims the benefit of priority under 35 U.S.C. §119(e) to provisional U.S. Patent Application No. 61/632,116, filed on Jan. 18, 2012, the entire contents of which are hereby incorporated by reference.

BACKGROUND

A vehicular ad hoc network (VANET) is a mobile network that uses moving vehicles as nodes in the mobile network. For example, a VANET turns participating vehicles into a wireless router or node, allowing vehicles within approximately 100 to 300 meters of each other to connect and to create a network with a wide range. As vehicles fall out of signal range and drop out of the network, other vehicles can join in, connecting vehicles to one another so that a mobile Internet is created.

There are various types of VANETs, including, e.g., vehicle-to-infrastructure (V2I) networks, vehicle-to-vehicle (V2V) networks, and so forth. Generally, a V2I network includes a network of vehicles and roadside infrastructure for promoting communication among the vehicles and the roadside infrastructure. There are various type of roadside infrastructure, including, e.g., roadside units (RSUs). Generally, a RSU includes a device for providing vehicles with information, e.g., safety warnings and traffic information. Generally, a V2V network includes a network of vehicles for promoting communication among the vehicles.

SUMMARY

In one aspect of the present disclosure, a method performed by one or more processors includes receiving a notification message indicative of an occurrence of an event; determining that a position of a vehicular device that is associated with the one or more processors is located on a boundary of a reachability area surrounding a source of the event; determining that a direction of movement of the vehicular device is towards the source; responsive to determining that the position is on the boundary of the reachability area and that the direction of movement of the vehicular device is towards the source, entering a roadside unit state in which the vehicular device acts a roadside unit for a pre-defined period of time; detecting one or more vehicular devices that are uninformed of the occurrence of the event and that are located outside of the reachability area; and broadcasting the notification message to the one or more uninformed vehicular devices.

Implementations of the disclosure can include one or more of the following features. In some implementations, the method also includes receiving, from at least one of the one or more uninformed vehicular devices, information indicating receipt of the broadcast notification message. In other implementations, the method includes detecting an absence of receipt of information indicating that at least one of the one or more uninformed vehicular devices received the broadcast notification message.

In still other implementation, entering the roadside unit state comprises causing movement of the vehicular device that is associated with the one or more processors to temporarily cease for re-broadcasting of the notification message. In some implementations, the method includes determining that the pre-defined period of time has elapsed; responsive to determining that the pre-defined period of time has elapsed: enabling movement of the vehicular device that is associated with the one or more processors; and transitioning from the roadside unit state to another state for performing one or more of storing the notification message, carrying the notification message, and forwarding the notification message.

In some implementations, the vehicular device that is associated with the one or more processors comprises the one or more processors. In other implementations, the notification message comprises one or more of traffic information, road information and safety information; wherein the event comprises one or more of traffic related conditions, an accident, and road related conditions; and wherein the source comprises one or more of a location of the traffic related conditions, a location of the accident, a vehicular device that caused the accident, and a location of the road related conditions.

In still other implementations, determining that the position of the vehicular device that is associated with the one or more processors is located on the boundary of the reachability area surrounding the source of the event comprises: determining, based on execution of a series of instructions, that the position of the vehicular device that is associated with the one or more processors is located on the boundary of the reachability area surrounding the source of the event; wherein the series of instructions comprise:

$\angle(A, S, i) \Leftarrow$ angle between a vector (from Vehicle A to Vehicle S) and another vector (from Vehicle A to Vehicle i) where $\angle(A, S, i) \in [-\pi, \pi]$.
$Nbr(A) \Leftarrow$ set of all neighboring vehicles of Vehicle A.
$d_A \Leftarrow$ moving direction of Vehicle A with respect to a line connecting from Vehicle A to Vehicle S.
When A receives the message for the first time from Vehicle S
for all $i \in Nbr(A) \setminus \{S\}$ do
  $\theta_i \Leftarrow \angle(A, S, i)$
end for
$\theta_- \Leftarrow \min(\min_i(\theta_i), 0)$
$\theta_+ \Leftarrow (\max(\max_i(\theta_i), 0)$
if $|\theta_+| + |\theta_-| < \pi$ and $d_A \in [\theta_-, \theta_+]$ then
  $A \Leftarrow$ temporary RSUs
end if wherein vehicle A comprises the vehicular device that is associated with the one or more processors; wherein vehicle S comprises one or more of the source and one of the one or more informed vehicles; and wherein vehicle i comprises a neighbor of vehicle A.

In some implementations, the method includes detecting a density of vehicular devices in proximity to the vehicular device associated with the one or more processors;

determining a size of the region of interest; and determining the pre-defined period of time based on the size of the region of interest and based on the density of vehicular devices in proximity to the vehicular device associated with the one or more processors. In still other implementations, the method includes indirectly detecting a rebroadcast of the notification message by at least one of the one or more uninformed vehicular devices to which the one or more processors originally broadcast the notification message, with indirect detection based on one or more of beacon messages and overhearing the notification message being broadcast by the at least one of the one or more uninformed vehicular devices; and in response to detecting, transitioning from the roadside unit state to another state for performing one or more of storing the notification message, carrying the notification message, and forwarding the notification message.

In still another aspect of the disclosure, one or more machine-readable media are configured to store instructions that are executable by one or more processors to perform operations including receiving a notification message indicative of an occurrence of an event; determining that a position of a vehicular device that is associated with the one or more processors is located on a boundary of a reachability area surrounding a source of the event; determining that a direction of movement of the vehicular device is towards the source; responsive to determining that the position is on the boundary of the reachability area and that the direction of movement of the vehicular device is towards the source, entering a roadside unit state in which the vehicular device acts a roadside unit for a pre-defined period of time; detecting one or more vehicular devices that are uninformed of the occurrence of the event and that are located outside of the reachability area; and broadcasting the notification message to the one or more uninformed vehicular devices.

Implementations of this aspect of the present disclosure can include one or more of the foregoing features.

In still another aspect of the disclosure, an electronic system includes one or more processors; and one or more machine-readable media configured to store instructions that are executable by the one or more processors to perform operations including: receiving a notification message indicative of an occurrence of an event; determining that a position of a vehicular device that is associated with the one or more processors is located on a boundary of a reachability area surrounding a source of the event; determining that a direction of movement of the vehicular device is towards the source; responsive to determining that the position is on the boundary of the reachability area and that the direction of movement of the vehicular device is towards the source, entering a roadside unit state in which the vehicular device acts a roadside unit for a pre-defined period of time; detecting one or more vehicular devices that are uninformed of the occurrence of the event and that are located outside of the reachability area; and broadcasting the notification message to the one or more uninformed vehicular devices. Implementations of this aspect of the present disclosure can include one or more of the foregoing features.

All or part of the foregoing can be implemented as a computer program product including instructions that are stored on one or more non-transitory machine-readable storage media, and that are executable on one or more processors. All or part of the foregoing can be implemented as an apparatus, method, or electronic system that can include one or more processors and memory to store executable instructions to implement the stated operations.

The details of one or more implementations are set forth in the accompanying drawings and the description below. Other features, objects, and advantages will be apparent from the description and drawings, and from the claims.

DETAILED DESCRIPTION

A system consistent with this disclosure expands a communication range of a VANET by causing vehicular devices in the VANET to act as fixed-point communication nodes, e.g., for a pre-defined and temporary period of time. There are various types of fixed-point communication nodes, including, e.g., RSUs. By causing vehicular devices to act as fixed-point communication nodes, the system enables a V2V network to act as a V2I network, e.g., without the expense of the infrastructure associated with a V2I network. As a temporary RSU, a vehicular device can make a brief stop and take on or assume tasks of a conventional RSU—relaying messages to nearby vehicles and acting as a communication bridge for other vehicles in the network.

Figure 1:
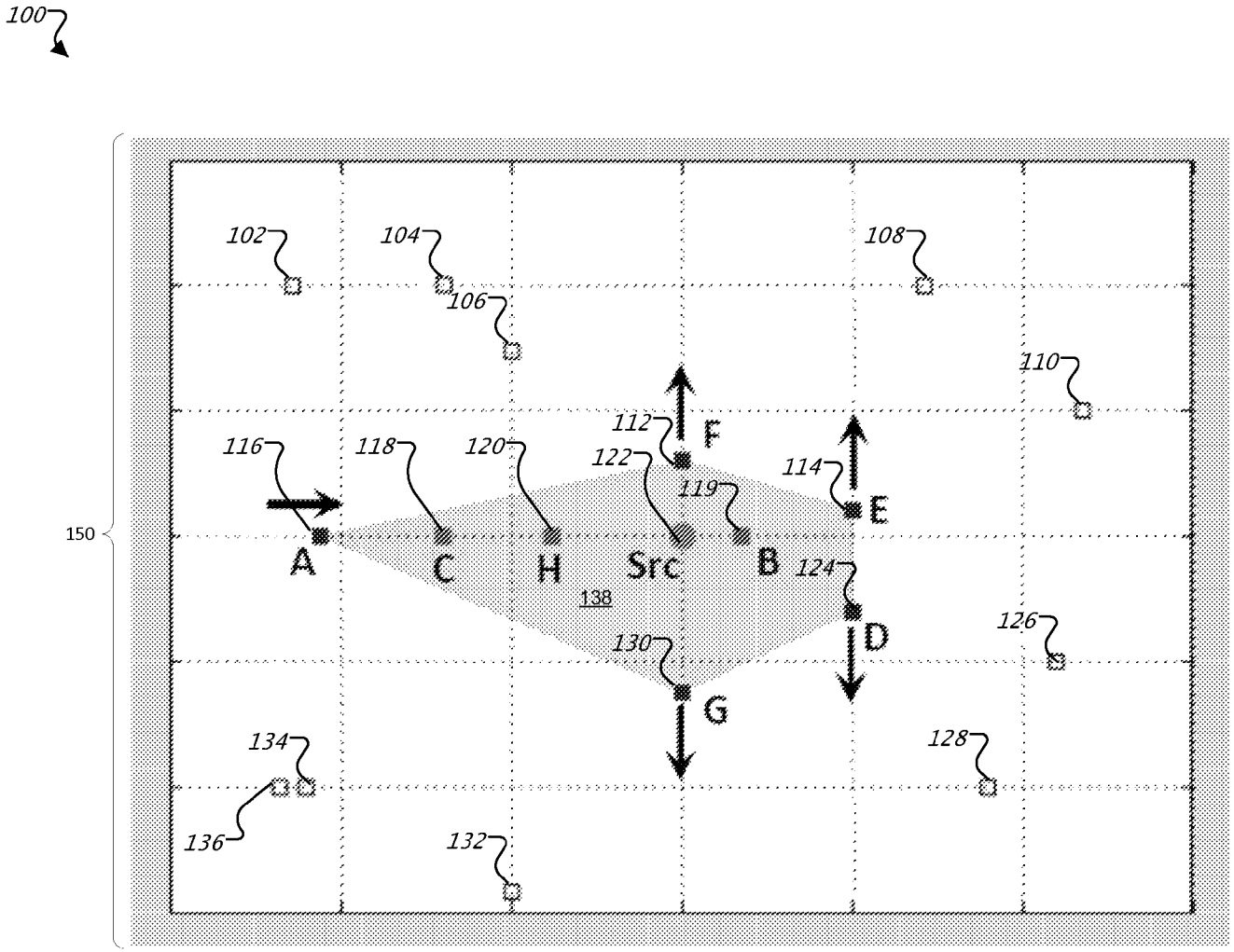
FIG. 1 shows an example of a VANET.

Referring to FIG. 1, example environment 100 is shown. Example environment 100 includes a post-crash notification (PCN) environment. Example environment 100 includes an absence of fixed infrastructure. Example environment 100 includes region of interest 150 and reachability area 138, each of which are described in further detail below.

In the PCN environment, safety messages are disseminated to vehicles within region of interest 150, which is an area surrounding a source of an event. In this example, region of interest 150 includes reachability area 138.

Generally, a reachability area includes an area surrounding a source of an event that is within a communication range of the source (and/or within a communication range of a vehicle at the source). In this example, the event may be a traffic-related event—an accident, and a road related event, and so forth. In this example, the source may be one or more of a location of the traffic related event, a location of the accident, a vehicular device that caused the accident, a location of the road related event, and so forth. Generally, a safety message includes information about an event. In an example, the event is an accident. In this example, the safety message includes information indicative of a time of the accident, a location of the accident, and so forth. Generally, a safety message may be issued by a vehicle involved in the accident, an emergency services vehicle (e.g., a police car), a bystander, a bystander vehicle, and so forth.

In the example of FIG. 1, reachability area 138 initially corresponds to a region which includes all the vehicles that receive the first broadcast by the source vehicle (e.g., vehicle 122) at the accident scene. Reachability area 138 is time-dependent and expands as time increases after the first broadcast by the source vehicle. In this example, reachability area 138 may converge to region of interest 150 asymptotically with time. In this example, initially the reachability area 138 is a small subset of region of interest 150 but eventually reachability area 138 converges or becomes equal to region of interest 150. In this example, a vehicle acting as a RSU promotes dissemination of safety messages to vehicles within region of interest 150.

In the example of FIG. 1, environment 100 includes vehicles 102, 104, 106, 108, 110, 112, 114, 116, 118, 120, 122, 124, 126, 128, 130, 132, 134, 136. Each of vehicles 102, 104, 106, 108, 110, 112, 114, 116, 118, 120, 122, 124, 126, 128, 130, 132, 134, 136 may include various types of vehicular devices, including, e.g., personal cars, buses, subway trains, taxis, and so forth. In this example, vehicle 122 is a source of the accident. Following the accident, vehicle 122 sends out a message (i.e., a notification message, post-crash notification message, a safety message, and so forth) to other vehicles in environment 100. In this example, the sent message includes one or more of traffic information, road information and safety information about an event that has occurred at a source.

In this example, reachability area 138 (e.g., the gray-shaded region) surrounds vehicle 122. In this example, other vehicles included in reachability area 138 are in a communication range of vehicle 122. After the broadcast from vehicle 122, vehicles 112, 114, 116, 118, 120, 124, 130 in reachability area 138 receive the message and are informed about the accident. In this example, vehicles 112, 114, 116, 118, 120, 124, 130 are informed of the accident via spatial relays from vehicle 122 or other informed vehicles, e.g., vehicles that are informed of the message and/or vehicles that are informed of the event (e.g., the accident). In an example, informed vehicles are informed of the event via the broadcast of the safety message from vehicle 122. In another example, informed vehicles are informed of the event based on proximity of the informed vehicle to a source of the event. For example, a police car that is in vicinity of a source of an event is an informed vehicle, e.g., because a police officer who is using the police car may use the police car to transmit safety messages to other vehicles that are in proximity to the police car. In this example, reachability area 138 includes vehicles that can receive messages from vehicle 122 via direct transmission or via multi-hop forwarding.

In an example, vehicles 102, 104, 106, 108, 110, 126, 128, 132, 134, 136 are located outside of reachability area 138, are outside of a communication range of vehicle 122, and are inside of region of interest 150. In this example, vehicles 102, 104, 106, 108, 110, 126, 128, 132, 134, 136 do not receive the safety message from vehicle 122. In this example, one or more of vehicles 112, 114, 116, 118, 120, 124, 130 include a RSU determination module (not shown) to identify when a vehicle should act as a RSU, e.g., to promote dissemination of the safety message to uninformed vehicles that are outside of reachability area 138. Generally, an uninformed vehicle includes a vehicle that has not received the message originally broadcast from the source, e.g., from vehicle 122. Generally, a RSU dissemination module includes a series of instructions that are executable by a processor (e.g., a processor included in a vehicle) to determine if the vehicle should act as a temporary RSU. In an example, the processor may be associated with the vehicle, e.g., by being configured from communication with the vehicle and/or with one or more components of the vehicle.

In an example, the RSU determination module selects vehicles to act as temporary RSUs based on various criteria. One of these criteria is that the vehicle is positioned on a boundary of reachability area 138. Vehicles that are on the boundary (boundary vehicles) of reachability area 138 are in proximity to both informed vehicles and uninformed vehicles. Boundary vehicles have an increased probability of encountering uninformed vehicles, e.g., relative to a probability of non-boundary vehicles and informed vehicles meeting uninformed vehicles. In this example, because the non-boundary vehicles and the informed vehicles are mostly surrounded by informed vehicles, selection of the non-boundary vehicles and the informed vehicles as temporary RSUs does not significantly increase the dissemination of the safety messages, e.g., relative to dissemination of the safety message when the non-boundary vehicles and the informed vehicles do not act as RSUs.

Another criteria for a RSU determination module to select a vehicle to act as a temporary RSU is that the vehicle is moving in a direction towards a source (e.g., a source of the accident). That is, in addition to using the position of vehicles in determining whether a vehicle acts a temporary RSU, the RSU determination module also uses a movement direction of the vehicle in determining whether the vehicle acts a temporary RSU. In this example, the RSU determination module is configured to select boundary vehicles that travel toward the accident as temporary RSUs. By having these boundary vehicles act as RSUs and stop at current locations for a brief period of time (and not continue to travel toward the accident scene), the subsequent rebroadcasts from these boundary vehicles may reach uninformed vehicles, when these uninformed vehicle arrive into the RSUs' neighborhoods (e.g., areas surrounding the RSUs). In this example, the RSU determination module is configured to not select as temporary RSUs those boundary vehicles that travel in the outward direction from the scene of accident. For example, in FIG. 1, the RSU determination module is configured to not select as temporary RSU vehicles 112, 114, 124, 130. In an example, a RSU determination module is configured to determine whether a vehicle acts as an RSU based on various factors, e.g., based on various directions of the vehicle relative to a source of an event, based on a position of a vehicle relative to the source, and so forth. In this example, the RSU determination module may be configured to make the following determinations, e.g., using the techniques and algorithms described herein.

For example, the RSU determination module may determine that vehicles that are close to a source (e.g., within predefined distance of the source and/or on a boundary of a reachability area for the source) and moving towards the source should act as temporary RSUs. The RSU determination module may also determine that stationary vehicles that are close to the source should not act as temporary RSUs, e.g., as these vehicles are not moving towards the source. The RSU determination module may also determine that vehicles that are not close to the source (e.g., not within the reachability area for the source), but are moving towards the source, should also not act as temporary RSU. The RSU determination module may also determine that vehicles that are close to the source (e.g., within the reachability area for the source and/or on a boundary of the reachability area for the source), but are moving away from the source, should not act as a temporary RSU. The RSU determination module may also determine that vehicles that are not close to the source (e.g., not within the reachability area for the source) and are moving away from the source should not act as a temporary RSU.

In the example of FIG. 1, one or more of vehicles 102, 104, 106, 108, 110, 112, 114, 116, 118, 120, 122, 124, 126, 128, 130, 132, 134, 136 include the RSU determination module. In this example, receipt of a safety message (and/or another type of notification message) causes execution of the RSU determination module. In this example, vehicle 116 executes its RSU determination module. Based on execution of the RSU determination module, a processor inside vehicle 116 determines that vehicle 116 is on a boundary of reachability area 138 and is moving towards vehicle 122, e.g., the source of an event. In this example, the RSU determination module of vehicle 116 identifies that vehicle 116 should act as an RSU and causes vehicle 116 to enter a RSU state, e.g., a condition in which vehicle 116 temporarily stops movement and re-transmits the safety message to uninformed vehicles in a communication range of vehicle 116. At a later time instance, the uninformed vehicles in a communication range of vehicle 116 may include one or more of vehicles 102, 104, 106, 134, 136. In this example, vehicle 116 performs RSU rebroadcasts to disseminate the safety messages to uninformed vehicles through spatial relays. Generally, a RSU rebroadcast includes a rebroadcast from a vehicle in a RSU state. In the example of FIG. 1, vehicle 116 may have various types of radio equipment installed, e.g., to promote RSU rebroadcasts. There are various different types of radio equipment, including, e.g., Dedicated Short Range Communications (DSRC) radio equipment, wireless fidelity (WiFi) radio equipment, and so forth, As previously described, there are various ways in which a vehicle acting as a RSU may be configured to disseminate notification messages. In one example of a pre-emptive scheme, vehicle 116 that is acting as a RSU temporarily stops to rebroadcast the notification message. If vehicle 116 hears any of the vehicles rebroadcasting the notification message, then vehicle 116 will consider this as an implicit acknowledgement of receipt of the notification message and change its state from the RSU state to the SCF state and resume its trip.

There are various other techniques a vehicle acting as a RSU may implement to disseminate notification messages. In another example of a timer-based approach, vehicle 116 implements a timer based approach in which vehicle 116 stops for a pre-defined period of time (e.g., thirty seconds) to transmit the notification message and then resumes its trip. In this example, vehicle 116 acting as a RSU promotes network connectivity for the pre-defined period of time. If vehicle 116 cannot relay the notification message to another vehicle, vehicle 116 resumes its trip.

In an example, a vehicle acts as a RSU for forty-five seconds. In this example, the RSU fails to detect beacon messages (which implicitly indicate acknowledgement of the safety message) or to overhear the same safety message being broadcast by some of the uninformed vehicles, e.g., within the forty-five seconds that it is waiting. However, other vehicles may be moving towards the source of the event. These other vehicles may be selected as the RSU, e.g., when these other vehicles come within the transmission range of the source. When these other vehicles are selected to act as RSUs, these other vehicles wait for forty-five seconds in search of the next RSU.

In still another example, a vehicle acting as a RSU may temporarily stop for a minimum amount of time, e.g., min (t', t_max), where min (x,y) is a function that returns the smaller of x and y in the argument. In this example, t' is the time needed to establish a new RSU with the preemptive scheme and t_max is the fixed maximum time used in the timer based approach.

In the example of FIG. 1, vehicles 112, 114, 124, 130 also include RSU determination modules. These RSU determination modules determine that vehicles 112, 114, 124, 130 are on a boundary of reachability area 138 and are moving away from the source of the accident (e.g., vehicle 122). Because vehicles 112, 114, 124, 130 are moving away from the source of the accident, the RSU determination modules in these vehicles do not select vehicles 112, 114, 124, 130 for transition to a RSU state. However, because vehicles 112, 114, 124, 130 are on a boundary of reachability area 138 and are moving away from the source, the RSU determination modules of these vehicles cause these vehicles to transition to another state, e.g., a store, carry, and forward (SCF) state. In this example, a RSU determination module is configured to cause a vehicle to transition to a SCF state, e.g., when the vehicle is on the boundary of reachability area 138 and when the vehicle is moving away from the source. In a SCF state, a vehicle performs SCF rebroadcasts to disseminate messages to uninformed vehicles through spatial relays. Generally, a SCF rebroadcast includes a rebroadcast from a vehicle in a SCF state. In this example, vehicles 118, 119, 120 also include RSU determination modules. In this example, RSU determination modules in each of vehicles 118, 119, 120, respectively, determine that vehicles 118, 119, 120 are not on a boundary of reachability area 138. In this example, RSU determination modules in each of vehicles 118, 119, 120 determine that vehicles 118, 119, 120 should not enter a RSU state or a SCF state.

In the example of FIG. 1, vehicle 116 is configured to execute an algorithm to determine reachability area 138 and a boundary of reachability area 138. For purposes of convenience, a vehicle and a vehicular device may interchangeably be referred to as vehicle, without limitation. Vehicle 116 is configured to execute various types of algorithms, including, e.g., a gift-wrapping algorithm. Generally, a gift-wrapping algorithm is an algorithm for computing the convex hull of a given set of points. In this example, the gift-wrapping algorithm is a distributed algorithm, in which a vehicle, upon receiving a message, can determine independently and in a distributed manner whether it lies on the boundary of a reachability area.

The RSU determination module combines additional rules that consider directions of vehicles with a distributed gift-wrapping algorithm to generate an RSU determination algorithm, as shown in the below Table 1. Generally, a RSU determination algorithm includes a series of executable instructions to identify when a vehicle should transition to a RSU state.

TABLE 1

$\angle(A, S, i) \Leftarrow$ angle between a vector (from Vehicle A to Vehicle S) and another vector (from Vehicle A to Vehicle i) where $\angle(A, S, i) \in [-\pi, \pi]$.

$Nbr(A) \Leftarrow$ set of all neighboring vehicles of Vehicle A.

$d_A \Leftarrow$ moving direction of Vehicle A with respect to a line connecting from Vehicle A to Vehicle S.

When A receives the message for the first time from Vehicle S for all $i \in Nbr(A) \setminus \{S\}$ do $\theta_i \Leftarrow \angle(A, S, i)$ end for $\theta_- \Leftarrow \min(\min_i(\theta_i), 0)$ $\theta_+ \Leftarrow (\max(\max_i(\theta_i), 0)$ TABLE 1-continued

| |
|---|
| if $\lvert\theta_+\rvert + \lvert\theta_-\rvert < \pi$ and $d_A \in [\theta_-, \theta_+]$ then<br>A⇐ temporary RSUs<br>end if |

Figure 2A:
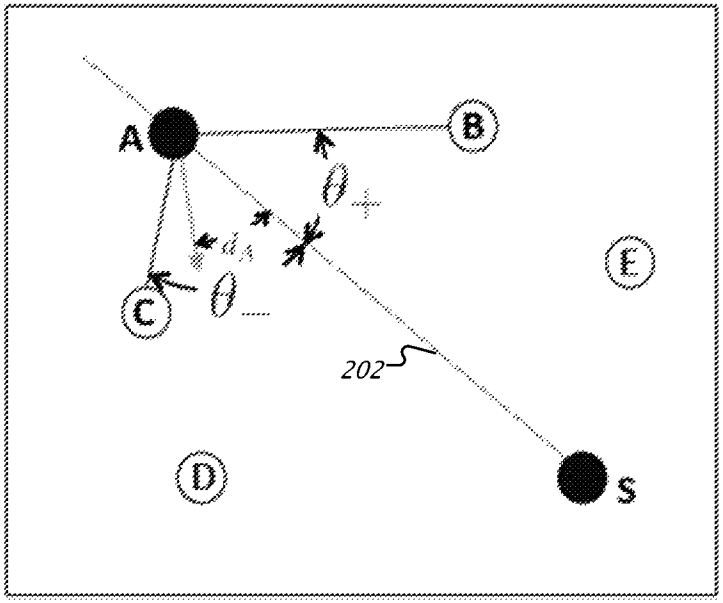
FIGS. 2A and 2B show images of angles that are determined by a RSU determination algorithm.
Figure 2B:
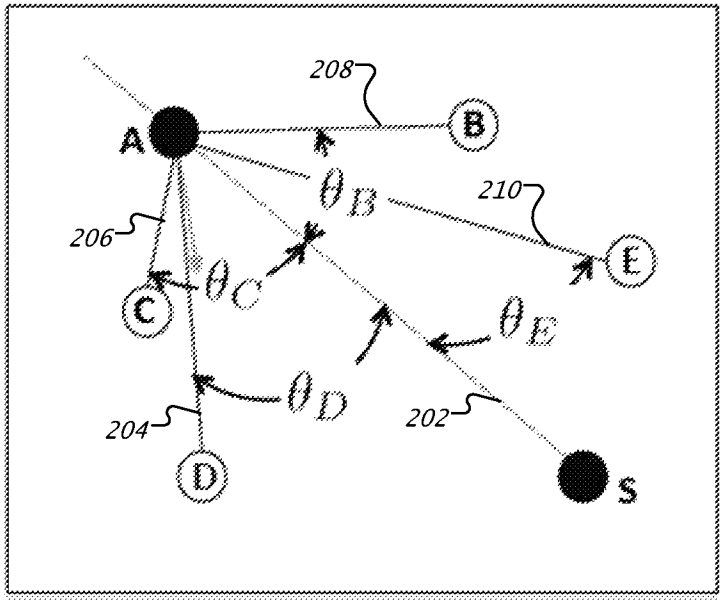

In the above Table 1, vehicle A is a vehicle in a reachability area for a source of an accident and it receives the safety message from vehicle S which could be a vehicle at the source and/or one of the one or more informed vehicles. Vehicle i is a vehicle that neighbors vehicle A, e.g., by being within a pre-defined distance of vehicle A. FIGS. 2A and 2B are illustrations of how RSUs are selected using the algorithm shown in the above Table 1. Referring to FIG. 2A, vehicle S is a vehicle at the source and/or one of the one or more informed vehicles. In this example, vehicle S transmits a safety message to vehicle A. In this example, a RSU determination module included in vehicle A determines straight line path 202 between vehicle A and vehicle S based on the location information of vehicle S that is included in the safety message. Vehicle A determines this line to vehicle S based on the GPS information available at Vehicle S, which is included in the safety message sent by Vehicle S. In this example, vehicle A detects that vehicles B, C, D, E are in proximity to vehicle A and are neighbors of vehicle A through a process known in the art as "beaconing". As part of the beaconing process, each vehicle broadcasts its location and direction information at regular intervals (e.g., every 100 msec in the case of DSRC radios). Vehicle A can detect that vehicles B, C, D, E are in proximity of vehicle A and are neighbors of vehicle A if vehicle A receives one or more beacons from vehicles B, C, D, and E, respectively. Location information of the neighbors may be stored in an on-board location database. Based on the location information of all neighbors stored in the database, the RSU determination module at vehicle A determines straight line path 208 between vehicle A and vehicle B. The RSU determination module determines straight line path 210 between vehicle A and vehicle E. The RSU determination module determines straight line path 204 between vehicle A and vehicle D. The RSU determination module determines straight line path 206 between vehicle A and vehicle C.

Upon receiving the message from Vehicle S, Vehicle A computes an angle $\theta_i$ for its neighbors. In the example of FIG. 1, vehicle A (and/or the RSU determination module in vehicle A) computes angles $\theta_B$, $\theta_C$, $\theta_D$, $\theta_E$ Angle $\theta_B$ includes an angle between straight line paths 202, 208. Angle $\theta_C$ includes an angle between straight line paths 202, 206. Angle $\theta_D$ includes an angle between straight line paths 202, 204. Angle $\theta_D$ includes an angle between straight line paths 202, 204. From angles $\theta_B$, $\theta_C$, $\theta_D$, $\theta_E$, the RSU determination module in vehicle A identifies a minimum angle ($\theta_-$) and a maximum angle ($\theta_+$).

Referring to FIG. 2B, vehicles B and C are the neighbors of vehicle A that have the maximum and minimum angles, respectively. In the example of FIG. 2B, RSU determination module also identifies $d_A$, which is the moving direction of vehicle A with respect to straight line path 202. In this example, vehicle A knows its movement direction (e.g., $d_A$) or direction in which it is heading to. In this example, the RSU determination module determines that vehicle A is on a boundary of a reachability area surrounding vehicle A, e.g., based on a value of $\lvert\theta_+\rvert+\lvert\theta_-\rvert$ being less than $\pi$. In this example, the RSU determination module also determines that vehicle A is moving in a direction that is towards vehicle S, e.g., based on a moving direction $d_A$ of vehicle A falling between $\theta_-$and $\theta_+$. In this example, the RSU determination module identifies that vehicle A should act as a temporary RSU and causes vehicle A to transition to a RSU state.

Referring back to FIG. 1, the RSU determination module may determine that vehicle 112 is on a boundary of reachability area 138, e.g., based on a value of $\lvert\theta_+\rvert+\lvert\theta_-\rvert$ for vehicle 112 being less than $\pi$. In this example, the RSU determination module also determines that vehicle 112 is moving in a direction that is away from vehicle 122, e.g., based on a moving direction d of vehicle 112 not falling between $\theta_-$ and $\theta_+$. In this example, the RSU determination module identifies that vehicle 112 should enter a SCF state, e.g., to further promote dissemination of the messages.

In some embodiments, the RSU determination module determines that vehicle 120 is included in reachability area 138, e.g., rather than being on the boundary of reachability area 138, based on a value of $\lvert\theta_+\rvert+\lvert\theta_-\rvert$ for vehicle 120 being greater than $\pi$. In this example, the RSU determination module identifies that vehicle 120 should remain in its current state, e.g., rather than transitioning to a SCF state or to a RSU state. In this example, the RSU determination module determines that vehicle 120 should remain in its current state, e.g., independent of the direction in which vehicle 120 is moving relative to vehicle 122.

In the example of FIG. 1, vehicle 116 acts as a RSU and makes a brief stop to periodically rebroadcast a safety message, e.g., to mimic the role of fixed RSUs. As previously described, environment 100 includes a PCN environment. In a variation of FIG. 1, a RSU determination module may be deployed in various other environments, including, e.g., autonomous driving, autonomous robots, rail transportation, maritime application, forklifts, manned and/or unmanned vehicles in warehouses, and so forth. In some environments, the RSU may be configured to disseminate various types of information, e.g., instant messaging messages, content for download by vehicles, and so forth.

In an example, the RSU determination module is configured to determine an amount of time in which a vehicle remains in a RSU state. In an example, if a vehicle in a RSU state does not stop long enough to encounter uninformed vehicles, then message reachability does not increase. Generally, message reachability includes a fraction of vehicles in a network that receive a message. In another example, if a vehicle in a RSU state stops for too long, the travel delays of the vehicles that act as temporary RSUs are increased and message reachability also decreases. In an example, message reachability decreases when as the amount of time a vehicle acts as a RSU increases, for at least the following reasons. Uninformed vehicles that are outside a reachability area can be informed by receiving RSU rebroadcasts or SCF rebroadcasts. In an example, a network has a 20% DSRC penetration rate. In this example, when a temporary RSU's stop time increases from 10 seconds to 30 seconds, more uninformed vehicles benefit from the temporary RSU rebroadcasts. As the stop time of the temporary RSU exceeds 30 seconds, message reachability degrades due to two reasons: i) there are very few rebroadcasts made by a vehicle remaining in a RSU state during the excess time since vehicles that come into contact with the RSU during this time period are already informed via SCF rebroadcasts; and ii) a vehicle remaining in a RSU state for an extended period of time decreases the chance for the vehicle to do SCF rebroadcasts. That is, once the vehicle completes its RSU task of performing RSU rebroadcast, the vehicle could do additional SCF rebroadcasts and further improve the message reachability.

In this example, the RSU determination module is configured to calculate an amount of time in which a vehicle remains in a RSU state, with the calculation based on vehicle density of a region of interest, a size of the region of interest, and topology of the network surrounding the vehicle. In an example, when a vehicle acts as a RSU for a defined period of time, message reachability in a VANET increases, e.g., relative to message reachability independent of vehicles acting as RSUs (e.g., without vehicles acting as RSUs). In an example, a control system (not shown) may be configured to generate various metrics indicative of an effectiveness of causing a vehicle to act as a RSU. One of these vehicles may include a metric indicative of message reachability. The metric indicative of message reachability may be based on transitive connectivity and reachability among vehicles. In an example, a vehicle that is designated as vehicle j is transitively reachable from another vehicle (e.g., vehicle i) at time t if and only if the two following conditions are met: (i) vehicle i is connected with vehicle j at a point in time before t; i.e., $\exists t'<t$, $A(i, j, t)=1$, or (ii) there exists a relay vehicle, vehicle k, such that $\exists t', t''$, where $t'\leq t''\leq t$, $A(i, k, t')=1$ and $A(k, j, t'')=1$. In this example, $A(i, j, t)$ is a connectivity indicator which takes on the value of 1 if there is a path available between vehicles i and j at time t, and 0 otherwise. The second condition implies that vehicle k receives a message from vehicle i at time t' and vehicle k then stores, carries and forwards this message to vehicle j at time t". Thus, vehicle j is transitively reachable from vehicle i (i.e., vehicle j receives a message from vehicle i).

In this example, the controller system determines that message reachability improves, e.g., when vehicles temporarily act as RSUs. Such an improvement is mainly due to the fact that vehicles that serve as RSUs stay in a network for a longer period of time, e.g., relative to a period of time in which these vehicles would otherwise stay in the network. In this example, a ratio of informed vehicles increases, e.g., relative to the ratio of informed vehicles independent of vehicles acting as RSU. This increase in the amount of informed vehicles (i.e., vehicles that have received the message) causes an increase in an amount of message rebroadcasts which reach the uninformed vehicles, e.g., relative to an amount of message rebroadcasts which reach the uninformed vehicles independent of vehicles acting as RSUs.

In an example, the control system may determine that message reachability varies with DSRC penetration rate. For example, the control system determines an increase in message reachability when RSU-vehicles are implemented in a network with sparse and moderately-dense DSRC-equipped vehicles (i.e., 10%-40% penetration rate), e.g., relative to message reachability in a network with highly-dense DSRC-equipped vehicles.

In the example of FIG. 1, vehicle 116 may include various types of vehicular devices, including, e.g., personal cars, buses, subway trains, taxis, and so forth. In an example, a subway trains includes a RSU determination module, e.g., for transitioning the subway train into a RSU state while the subway train is stopped at train stations. In an example, a bus includes a RSU determination module, e.g., for transitioning the bus into a RSU state while the bus is stopped at bus stops. In an example, a taxi includes a RSU determination module, e.g., for transitioning the taxi into a RSU state while the taxi is stopped at a tax stop. In an example, a personal car includes a RSU determination module, e.g., for transitioning the personal car into a RSU state for a brief, pre-defined period of time. In this example, these RSU determination modules (e.g., in buses, taxis, subway trains, and so forth) exploit the fact that these vehicles make periodic stops naturally on routine paths and the stopping time of the RSUs can thus be implemented in a natural and painless manner. In contrast, a RSU determination module in a personal car converts the car into a fixed-point communication node.

As previously described, a RSU is one type of fixed-point communication node. In this example, the RSU state is a type of fixed-point communication node state, in which a vehicle acts as a fixed-point communication node. Using the techniques described herein, a vehicle may include a module for causing the vehicle to enter a fixed-point communication node state.

In a variation of FIG. 1, multiple vehicles may act as a RSU, e.g., when multiple vehicles satisfy the conditions to transitioning to a RSU state. In another example, environment 100 may have increased effectiveness when environment 100 has a low density of DSRC equipped vehicles, e.g., when the penetration ratio of DSRC equipment is 10% of vehicles on the road. In this example, rush hours may be low density in terms of the percentage of vehicles equipped with DSRC radios.

Figure 3A:
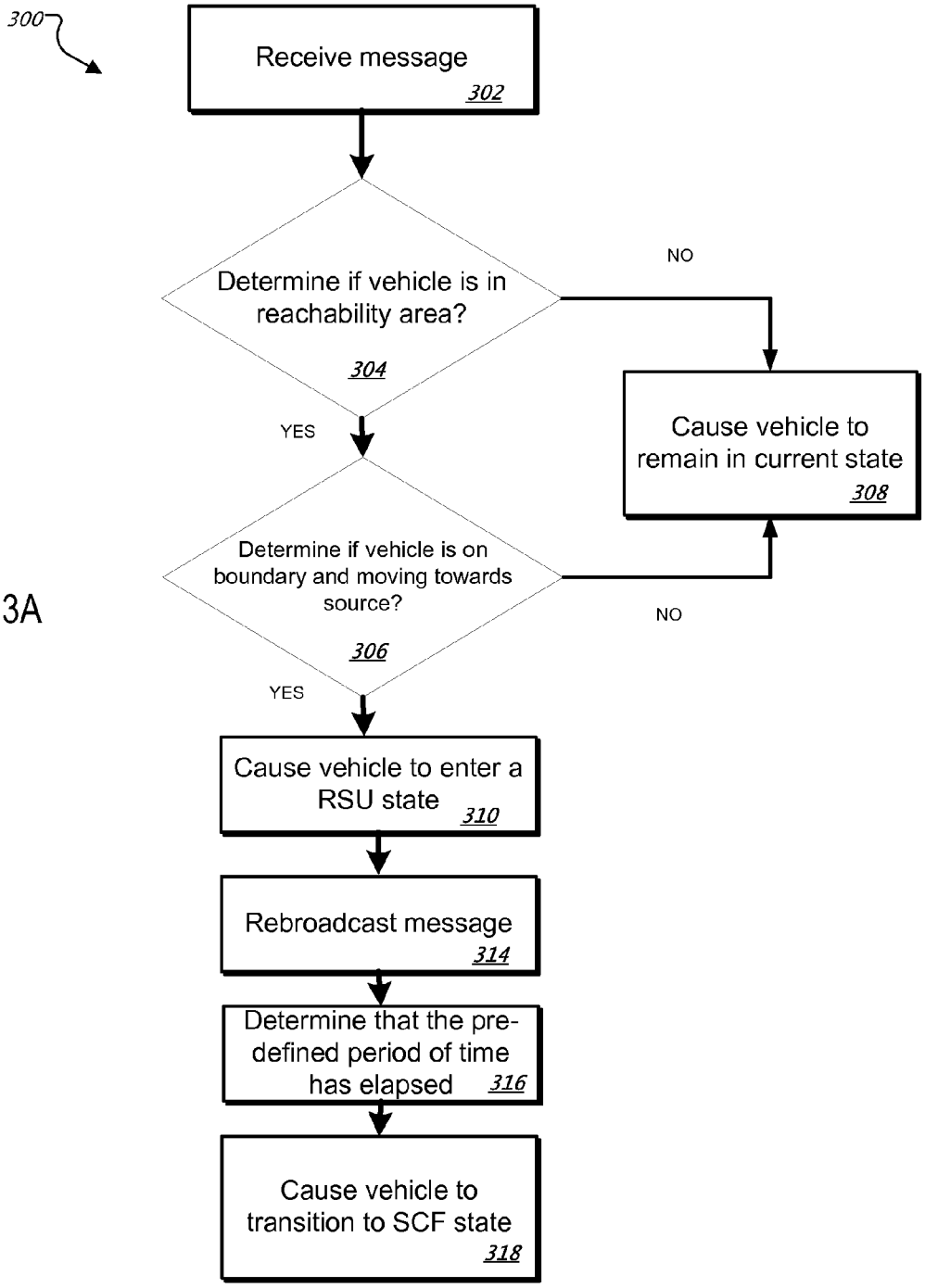
FIGS. 3A and 3B are flowcharts of processes for causing a vehicle to transition to a RSU state.

Referring to FIG. 3A, a RSU determination module in a vehicle (e.g., vehicle 116 in FIG. 1) executes process 300 causing the vehicle to transition into one or more of a RSU state and a SCF state. In operation, a RSU determination module receives (302) a message from a source of an event. In an example, a RSU determination module included in vehicle 116 receives a safety message from vehicle 122. Based on receipt of the message, the RSU determination module detects an occurrence of an event at the source.

In the example of FIG. 3A, the RSU determination module determines (304) if vehicle 116 is located in a reachability area for the source of the event. For example, using the above described techniques, the RSU determination module determines if vehicle 116 is located in reachability area 138. In an example, the RSU determination module determines that a vehicle is not included in a reachability area for a source of an event. In this example, the RSU determination module causes (308) the vehicle to remain in a current state.

In still another example, the RSU determination module determines that a vehicle is included in a reachability area for a source of an event. In this example, the RSU determination module also determines (306) if the vehicle is on the boundary of the reachability area and is moving in a direction towards the source of the event. In an example, the RSU determination module determines that the vehicle is either not on the boundary of the reachability area and/or is not moving in a direction towards the source of the event. In this example, the RSU determination module causes (308) the vehicle to remain in a current state.

In some embodiments, the RSU determination module determines that the vehicle is on the boundary of the reachability area and is moving in a direction towards the source of the event. For example, referring back to FIG. 2B, the RSU determination module determines that vehicle A is on a boundary of a reachability area surrounding vehicle A, e.g., based on a value of $|\theta_+|+|\theta_-|$ being less than $\pi$. In this example, the RSU determination module also determines that vehicle A is moving in a direction that is towards vehicle S, e.g., based on a moving direction $d_A$ of vehicle A falling between $\theta_-$ and $\theta_+$.

Referring back to FIG. 3A, following a determination that the vehicle is on the boundary of the reachability area and is moving in a direction towards the source of the event, the RSU determination module causes (310) the vehicle to enter a RSU state, in which the vehicle is stopped for a pre-defined period of time to temporarily act as a RSU. In the RSU state, the RSU determination module receives messages from uninformed vehicles that are in a communication range of the vehicle that is acting as the RSU. In an example, these messages include announcement messages that notify the vehicle acting as the RSU of the presence of these uninformed vehicles. In response to receipt of these messages, the RSU determination module rebroadcasts (314) the message received from the source of the event to the uninformed vehicles.

In the example of FIG. 3A, the RSU determination module also tracks an amount of time in which the vehicle that is acting as the RSU remains in the RSU state. In this example, the RSU determination module is configured to detect when the tracked amount of time equals the pre-defined period of time in which the vehicle should remain in the RSU state. In this example, the RSU determination module determines (316) that the pre-defined period of time has elapsed. In response, the RSU determination module causes (318) the vehicle that is acting as the RSU to transition to a SCF state. In the SCF state, the vehicle resumes its motion. Upon receiving announcement messages from uninformed vehicles, the vehicle in the SCF state rebroadcasts to the uninformed vehicles the message originally received from the source. In the example, the vehicle that is in the SCF state includes a processing device for determining whether the vehicle is in the region of interest for the source of the event. The processing device may include the RSU determination module or another module for executing instructions that determine a position of the vehicle relative to the region of interest. When the processing device detects that the vehicle has left the region of interest, the processing device causes the vehicle to exit the SCF state.

Figure 3B:
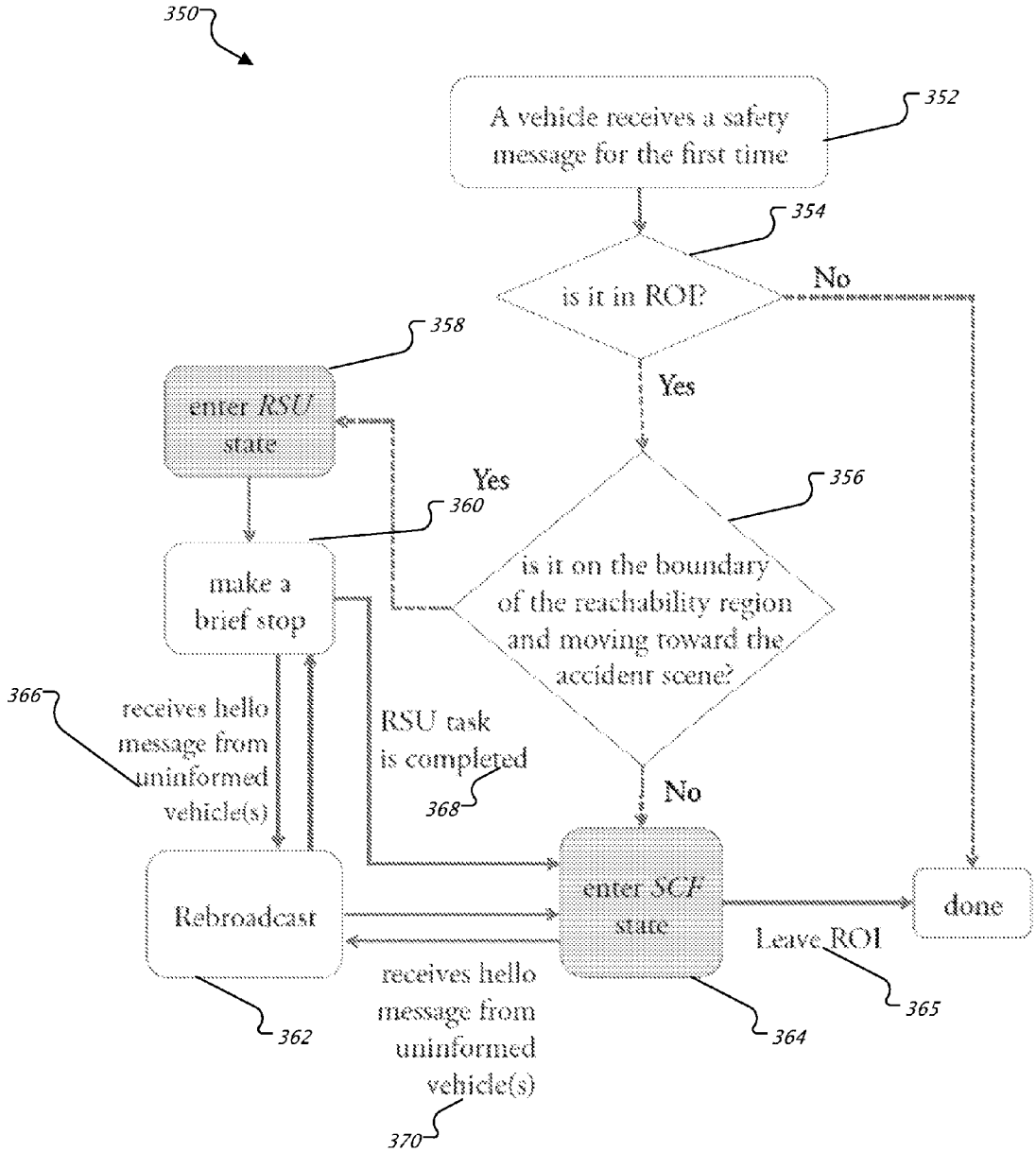

Referring to FIG. 3B, a RSU determination module in a vehicle (e.g., vehicle 116 in FIG. 1) executes process 350 causing the vehicle to transition into one or more of a RSU state and a SCF state. In operation, a RSU determination module receives (352) a safety message regarding an event occurring at a source. Based on receipt of the safety message, the RSU determination module determines (354) if vehicle 116 is in a region of interest for the event occurring at the source, e.g., by determining a current position of vehicle 116 relative to a known geographic location of the region of interest. In this example, the safety message may include information indicative of a location of the region of interest. Vehicle 116 may include one or more GPS systems that are used to detect a current geographic location of vehicle 116.

If the RSU determination module determines that vehicle 116 is not in a region of interest, then the RSU determination module completes its process and does not execute further instructions. If the RSU determination module determines that vehicle 116 is in a region of interest, then the RSU determines module determines (356) if vehicle 116 is on a boundary of the reachability area (also referred to herein as reachability region) for the source (e.g., an accident scene) and is moving toward the accident scene.

If the RSU determination module determines that vehicle 116 is either not on a boundary of the reachability area or is not moving toward the accident, the RSU determination module enters (364) a SCF state. Actions performed in the SCF state are described in further detail below. In this example, the RSU determination module also detects when vehicles 116 leaves (365) the region of interest. If the RSU determination module determines that vehicle 116 has left the region of interest, then the RSU determination module completes its process and does not execute further instructions.

If the RSU determination module determines that vehicle 116 is both on a boundary of the reachability area and is moving toward the accident, the RSU determination module enters (358) a RSU state. In the RSU state, vehicle 116 makes (360) a brief stop. During the brief stop, vehicle 116 receives (366) hello messages from uninformed vehicles. Generally, a hello message includes information announcing a presence of a vehicle. Responsive to the hello messages, the RSU determines module rebroadcasts (362) the safety message.

In the example of FIG. 3B, the RSU determination module determines (368) that its tasks are complete, e.g., based on a period of time in which vehicle 116 was to act as an RSU having elapsed. In this example, the RSU determination modules enters (364) the SCF state, as previously described. In the SCF state, vehicle 116 receives (370) hello messages from uninformed vehicles. Responsive to receipt of the hello messages, vehicle 116 rebroadcasts (362) the safety message. As previously described, when vehicle 116 leaves (365) the region of interest, the RSU determination module completes process 350.

Figure 4:
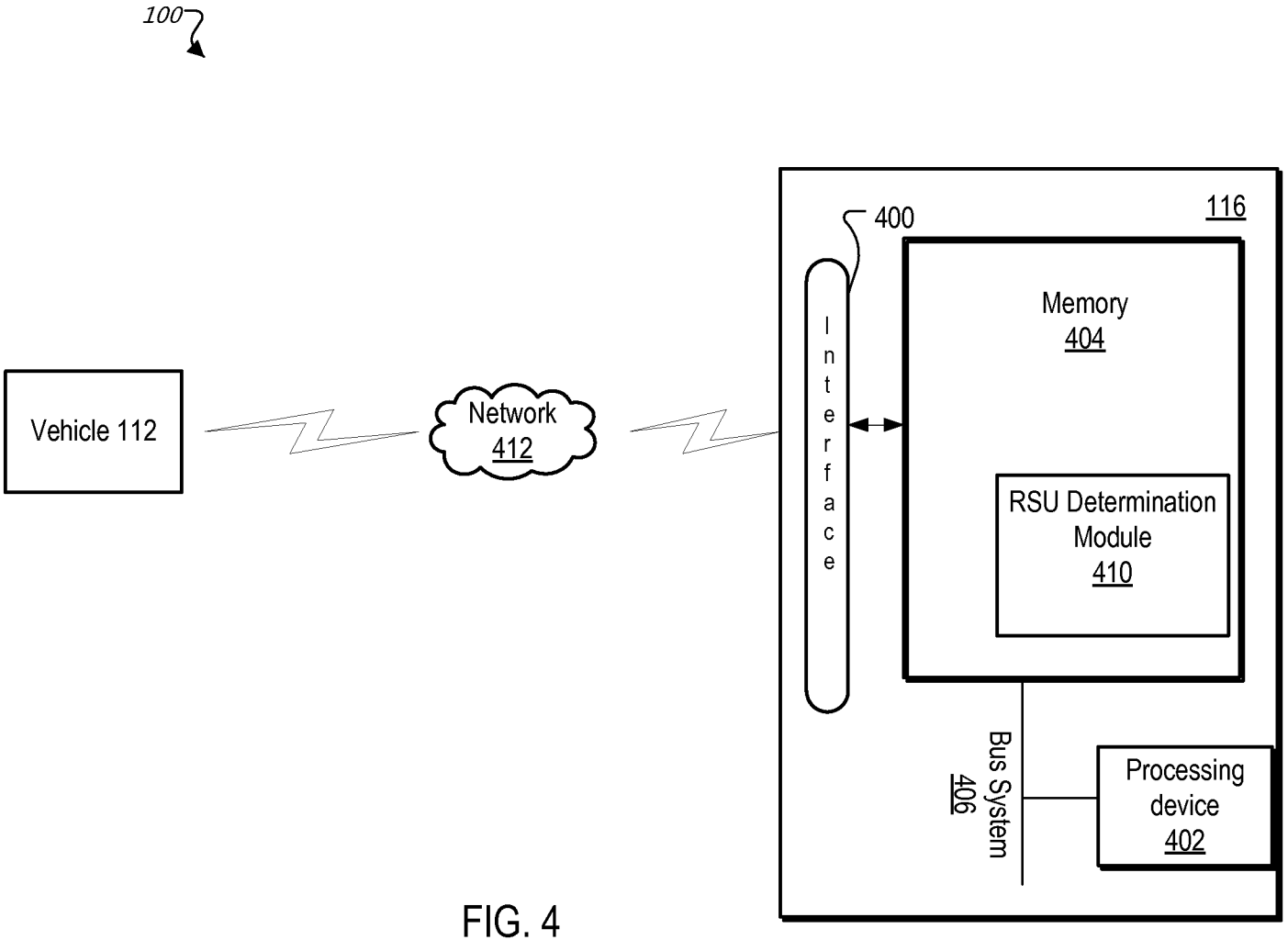
FIG. 4 is a block diagram of components in vehicle device that is configured to transition to a RSU state.

FIG. 4 is a block diagram showing examples of components of environment 100. In the example of FIG. 4, vehicle 116 can receive data from other vehicles (e.g., vehicle 112) through input/output (I/O) interface 400. I/O interface 400 can be a type of interface capable of receiving data over a network, including, e.g., an Ethernet interface, a wireless networking interface, a fiber-optic networking interface, a modem, and so forth. Vehicle 116 also includes a processing device 402 and memory 404. A bus system 406, including, for example, a data bus and a motherboard, can be used to establish and to control data communication between the components in vehicle 116.

Processing device 402 can include one or more microprocessors. Generally, processing device 402 can include an appropriate processor and/or logic that is capable of receiving and storing data, and of communicating over network 412. Examples of network 412 include a local area network ("LAN"), a wide area network ("WAN"), e.g., the Internet. Memory 404 can include a hard drive and a random access memory storage device, including, e.g., a dynamic random access memory, or other types of non-transitory machine-readable storage devices. As shown in FIG. 4, memory 404 stores computer programs that are executable by processing device 402. These computer programs may include RSU determination module 410 for implementing the operations and/or the techniques described herein. RSU determination module 410 can be implemented in software running on a computer device in vehicle 116, hardware or a combination of software and hardware.

Embodiments can be implemented in digital electronic circuitry, or in computer hardware, firmware, software, or in combinations thereof. Apparatus of the invention can be implemented in a computer program product tangibly embodied or stored in a machine-readable storage device and/or machine readable media for execution by a programmable processor; and method actions can be performed by a programmable processor executing a program of instructions to perform functions and operations of the invention by operating on input data and generating output.

The techniques described herein can be implemented advantageously in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Computer readable storage media are storage devices suitable for tangibly embodying computer program instructions and data include all forms of volatile memory such as RAM and non-volatile memory, including by way of example semiconductor memory devices, such as Erasable Programmable Read Only Memory (EPROM), Electrically Erasable Programmable Read Only Memory (EEPROM), and flash memory devices; magnetic disks such as internal hard disks and removable disks; magneto-optical disks; and CD-ROM disks. Any of the foregoing can be supplemented by, or incorporated in, ASICs (application-specific integrated circuits).

In another example, due to the nature of software, functions described above can be implemented using software, hardware, firmware, hardwiring, or combinations of any of these. Features implementing functions may also be physically located at various positions, including being distributed such that portions of functions are implemented at different physical locations.

A number of embodiments have been described. Nevertheless, it will be understood that various modifications can be made without departing from the spirit and scope of the processes and techniques described herein. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other embodiments are within the scope of the following claims.

What is claimed is:

1. A method performed by one or more processors, comprising:

receiving, at an interface of a vehicular device that is associated with the one or more processors, a notification message indicative of an occurrence of an event, wherein the interface is configured for communication with the one or more processors of the vehicular device;

determining that a position of the vehicular device is located on a boundary of a reachability area surrounding a source of the event, the boundary of the reachability area being the position of the vehicular device proximate to (i) one or more vehicular devices that are informed of the occurrence of the event and that are located inside of the reachability area, and (ii) one or more vehicular devices that are uninformed of the occurrence of the event and that are located outside of the reachability area;

determining that a direction of movement of the vehicular device is towards the source;

responsive to determining that the position is on the boundary of the reachability area and that the direction of movement of the vehicular device is towards the source, automatically controlling an operational state of the vehicular device for entering a roadside unit state in which the vehicular device acts a roadside unit for a pre-defined period of time;

detecting the one or more vehicular devices that are uninformed of the occurrence of the event and that are located outside of the reachability area; and broadcasting the notification message to the one or more uninformed vehicular devices.

2. The method of claim 1, further comprising:

receiving, from at least one of the one or more uninformed vehicular devices, information indicating receipt of the broadcast notification message.

3. The method of claim 1, further comprising:

detecting an absence of receipt of information indicating that at least one of the one or more uninformed vehicular devices received the broadcast notification message.

4. The method of claim 1, wherein entering the roadside unit state comprises causing movement of the vehicular device that is associated with the one or more processors to temporarily cease for re-broadcasting of the notification message.

5. The method of claim 1, further comprising:

determining that the pre-defined period of time has elapsed;

responsive to determining that the pre-defined period of time has elapsed:

enabling movement of the vehicular device that is associated with the one or more processors; and transitioning from the roadside unit state to another state for performing one or more of storing the notification message, carrying the notification message, and forwarding the notification message.

6. The method of claim 1, wherein the vehicular device that is associated with the one or more processors comprises the one or more processors.

7. The method of claim 1, wherein the notification message comprises one or more of traffic information, road information and safety information;

wherein the event comprises one or more of traffic related conditions, an accident, and road related conditions; and wherein the source comprises one or more of a location of the traffic related conditions, a location of the accident, a vehicular device that caused the accident, and a location of the road related conditions.

8. The method of claim 1, wherein determining that the position of the vehicular device that is associated with the one or more processors is located on the boundary of the reachability area surrounding the source of the event comprises:

determining, based on execution of a series of instructions, that the position of the vehicular device that is associated with the one or more processors is located on the boundary of the reachability area surrounding the source of the event;

wherein the series of instructions comprise:

```
∠(A, S, i) ⇐ angle between a vector (from Vehicle A to Vehicle S) and another vector (from
Vehicle A to Vehicle i) where ∠(A, S, i) ϵ [−π, π].
Nbr(A) ⇐ set of all neighboring vehicles of Vehicle A.
d_A ⇐ moving direction of Vehicle A with respect to a line connecting from Vehicle A to
Vehicle S.
When A receives the message for the first time from Vehicle S
for all i ϵ Nbr(A)\ {S} do
  θ_i ⇐ ∠(A, S, i)
end for
θ_⇐ min (min_i(θ_i), 0)
θ_+⇐ (max (max_i(θ_i), 0)
if |θ_+| + |θ_−| < π and d_A ϵ [θ_−, θ_+] then
  A⇐ temporary RSUs
end if
```

wherein vehicle A comprises the vehicular device that is associated with the one or more processors;

wherein vehicle S comprises one or more of the source and one of the one or more informed vehicular devices; and wherein vehicle i comprises a neighbor of vehicle A.

9. The method of claim 1, further comprising:

detecting a density of vehicular devices in proximity to the vehicular device associated with the one or more processors;

determining a size of the region of interest; and determining the pre-defined period of time based on the size of the region of interest and based on the density of vehicular devices in proximity to the vehicular device associated with the one or more processors.

10. The method of claim 1, further comprising:

indirectly detecting a rebroadcast of the notification message by at least one of the one or more uninformed vehicular devices to which the one or more processors originally broadcast the notification message, with indirect detection based on one or more of beacon messages and overhearing the notification message being broadcast by the at least one of the one or more uninformed vehicular devices; and in response to detecting, transitioning from the roadside unit state to another state for performing one or more of storing the notification message, carrying the notification message, and forwarding the notification message.

11. One or more non-transitory machine-readable media configured to store instructions that are executable by one or more processors to perform operations comprising: receiving, at an interface of a vehicular device that is associated with the one or more processors, a notification message indicative of an occurrence of an event, wherein the interface is configured for communication with the one or more processors of the vehicular device; determining that a position of the vehicular device is located on a boundary of a reachability area surrounding a source of the event, the boundary of the reachability area being the position of the vehicular device proximate to (i) one or more vehicular devices that are informed of the occurrence of the event and that are located inside of the reachability area, and (ii) one or more vehicular devices that are uninformed of the occurrence of the event and that are located outside of the reachability area; determining that a direction of movement of the vehicular device is towards the source; responsive to determining that the position is on the boundary of the reachability area and that the direction of movement of the vehicular device is towards the source, automatically controlling an operational state of the vehicular device for entering a roadside unit state in which the vehicular device acts a roadside unit for a pre-defined period of time; detecting the one or more vehicular devices that are uninformed of the occurrence of the event and that are located outside of the reachability area; and broadcasting the notification message to the one or more uninformed vehicular devices.

12. The one or more non-transitory machine-readable media of claim 11, wherein the operations further comprise: receiving, from at least one of the one or more uninformed vehicular devices, information indicating receipt of the broadcast notification message.

13. The one or more non-transitory machine-readable media of claim 11, wherein the operations further comprise: detecting an absence of receipt of information indicating that at least one of the one or more uninformed vehicular devices received the broadcast notification message.

14. The one or more non-transitory machine-readable media of claim 11, wherein entering the roadside unit state comprises causing movement of the vehicular device that is associated with the one or more processors to temporarily cease for re-broadcasting of the notification message.

15. The one or more non-transitory machine-readable media of claim 11, wherein the operations further comprise: determining that the pre-defined period of time has elapsed; responsive to determining that the pre-defined period of time has elapsed: enabling movement of the vehicular device that is associated with the one or more processors; and transitioning from the roadside unit state to another state for performing one or more of storing the notification message, carrying the notification message, and forwarding the notification message.

16. The one or more non-transitory machine-readable media of claim 11, wherein the vehicular device that is associated with the one or more processors comprises the one or more processors.

17. The one or more non-transitory machine-readable media of claim 11, wherein the notification message comprises one or more of traffic information, road information and safety information; wherein the event comprises one or more of traffic related conditions, an accident, and road related conditions; and wherein the source comprises one or more of a location of the traffic related conditions, a location of the accident, a vehicular device that caused the accident, and a location of the road related conditions.

18. The one or more non-transitory machine-readable media of claim 11, wherein determining that the position of the vehicular device that is associated with the one or more processors is located on the boundary of the reachability area surrounding the source of the event comprises: determining, based on execution of a series of instructions, that the position of the vehicular device that is associated with the one or more processors is located on the boundary of the reachability area surrounding the source of the event; wherein the series of instructions comprise:

$\angle(A, S, i) \Leftarrow$ angle between a vector (from Vehicle A to Vehicle S) and another vector (from Vehicle A to Vehicle i) where $\angle(A, S, i) \epsilon \{-\pi, \pi\}$ $Nbr(A) \Leftarrow$ set of all neighboring vehicles of Vehicle A $d_A$ moving direction of Vehicle A with respect to a line connecting from Vehicle A to Vehicle S When A receives the message for the first time from Vehicle S for all $i \epsilon Nbr(A) \backslash \{S\}$ do $\theta_i \angle(A, S, i)$ end for $\theta_- \Leftarrow \min(\min_i(\theta_i), 0)$ $\theta_+ \Leftarrow \max(\max_i(\theta_i), 0)$ if $|\theta_+| + |\theta_-| < \pi$ and $d_A \epsilon [\theta_-, \theta_+]$ then $A \Leftarrow$ temporary RSUs end if wherein vehicle A comprises the vehicular device that is associated with the one or more processors; wherein vehicle S comprises one or more of the source and one of the one or more informed vehicular devices; and wherein vehicle i comprises a neighbor of vehicle A.

19. An electronic system comprising:

one or more processors; and one or more machine-readable media configured to store instructions that are executable by the one or more processors to perform operations comprising:

receiving, at an interface of a vehicular device that is associated with the one or more processors, a notification message indicative of an occurrence of an event, wherein the interface is configured for communication with the one or more processors of the vehicular device;

determining that a position of the vehicular device is located on a boundary of a reachability area surrounding a source of the event, the boundary of the reachability area being the position of the vehicular device proximate to (i) one or more vehicular devices that are informed of the occurrence of the event and that are located inside of the reachability area, and (ii) one or more vehicular devices that are uninformed of the occurrence of the event and that are located outside of the reachability area;

determining that a direction of movement of the vehicular device is towards the source;

responsive to determining that the position is on the boundary of the reachability area and that the direction of movement of the vehicular device is towards the source, automatically controlling an operational state of the vehicular device for entering a roadside unit state in which the vehicular device acts a roadside unit for a pre-defined period of time;

detecting the one or more vehicular devices that are uninformed of the occurrence of the event and that are located outside of the reachability area; and broadcasting the notification message to the one or more uninformed vehicular devices.

20. The electronic system of claim 19, wherein the operations further comprise:

receiving, from at least one of the one or more uninformed vehicular devices, information indicating receipt of the broadcast notification message.

* * * * *